US005249740A

United States Patent [19]

Serra Tosio et al.

[11] Patent Number: 5,249,740

[45] Date of Patent: Oct. 5, 1993

[54] METHOD FOR REGULATING THE CONDITIONING OF A GAS AND GAS CONDITIONING DEVICE

[75] Inventors: Jean Marie Serra Tosio, 70, chemin de l'Eglise, 38240-Meylan; Yves Chave, 18 allée des Myosotis, 38610-Gieres, both of France

[73] Assignees: Assoc. de Gestion de L'ecole Francaise de Papeterie et D'Imprimerie; Jean Marie Serra-Tosio; Yves Chave, all of France

[21] Appl. No.: 797,786

[22] Filed: Nov. 25, 1991

[30] Foreign Application Priority Data

Nov. 27, 1990 [FR] France ..... 90 15134

[51] Int. Cl.[5] ..... B01F 3/02; F02M 23/14

[52] U.S. Cl. ..... 236/44 A; 261/152; 261/78.2

[58] Field of Search ..... 236/44 A, 44 R; 261/152, 78.2

[56] References Cited

U.S. PATENT DOCUMENTS

| | | | |
|---|---|---|---|
| 2,060,166 | 11/1934 | Bowen | 261/118 |
| 2,709,577 | 5/1955 | Pohndorf et al. | 261/2 |
| 3,532,270 | 10/1970 | Schoen, Jr. | 236/44 R |
| 4,038,980 | 8/1977 | Fodor | 261/13 C |
| 4,909,436 | 3/1990 | Hamner et al. | 236/44 A |

FOREIGN PATENT DOCUMENTS

| | | | |
|---|---|---|---|
| 1249223 | of 1961 | Fed. Rep. of Germany . | |
| 1009750 | of 1902 | France . | |
| 1093703 | of 1955 | France . | |
| 2558737 | of 1985 | France . | |
| 2564566 | of 1985 | France . | |
| 0122244 | 10/1978 | Japan | 236/44 A |
| 8801195 | of 1988 | PCT Int'l Appl. . | |

*Primary Examiner*—William E. Wayner
*Attorney, Agent, or Firm*—Wall and Roehrig

[57] ABSTRACT

Method and apparatus for regulating the conditioning of a gaseous flow that includes hearing the gas to a desired level and saturating it with a liquid at a reduced pressure and mixing the saturated gas with a second non-saturated gas in proportion to attain a desired conditioning.

16 Claims, 4 Drawing Sheets

METHOD FOR REGULATING THE CONDITIONING OF A GAS AND GAS CONDITIONING DEVICE

BACKGROUND OF THE INVENTION

The relates to a method for regulating the conditioning of a gas. It also relates to a device for conditioning a gas implementing this method; it relates more particularly to an adjustable, controllable device for regulating the vapour concentration and the temperature of a gaseous flow.

As is known, in essence, a gas conditioning device comprises in a thermostatted enclosure:

an inlet of gas to be conditioned, an evaporation and mixing humidifier device, an outlet of the conditioned gaseous flow.

In document FR-A-2,558,737, a humid gas generating device is proposed in which humidified air is mixed with dry air with a view to producing a humid reference gas, especially for monitoring and calibrating a hygrometer in industrial use, particularly adapted to regulation in the metallurgical industry. According to this document, the thermostatted humidifier is formed by a bubbling chamber partially filled with water to a constant level, connected on the one hand by a diffuser at the inlet of gas to be humidified, and on the other hand to an inlet tubing for water at a constant level and, finally, to an outlet of the humidified gas. This solution is perfectly suitable for low flow rates, especially for calibrating a probe or a hygrometer. However, because of the bubbling technique itself, this device may not be used for conditioning significant volumes, such as rooms, workshops or atomising apparatuses, which require large flow rates, as such flow rates are not compatible with a system for humidifying by bubbling.

Moreover, it is increasingly sought to produce conditioned air whose moisture content is controlled to within 1%, even to one part in a thousand. Such is especially the case for measurement apparatuses.

There has also been proposed, for example in document WO 88/01195, a humidifier device in which the humidification is obtained by atomizing a liquid into a mixing chamber, the said liquid being atomised in contact with an air inlet source. Thus, a gas which is humidified, even saturated, is indeed obtained, but with a very low efficiency, the mostly adiabatic evaporation causing the cooling the air-droplets mixture in the mixing chamber and, furthermore, the temperature of the atomized liquid is not regulated so that the gas is only partially conditioned.

SUMMARY OF THE INVENTION

One of the objects of the invention is to propose a method capable of permitting the humidification or the saturation of a gas to be carried out and, in general, a gas to be conditioned for relatively significant volumes by optimizing the process of saturating the said gas.

This method for regulating the conditioning of a gaseous flow, in which:

the temperature of the gas is brought to the desired conditioning temperature, the gas is saturated by means of a conditioning liquid, and the saturated and thermally conditioned gas thus obtained is mixed with the said non-saturated non-conditioned gas in a proportion depending on the desired conditioning, consists in saturating the gas in a reduced-pressure environment at a temperature in the vicinity of the temperature for conditioning the gas by atomizing the conditioning liquid brought to a temperature in the vicinity of the temperature for conditioning the said gas in the said reduced-pressure environment.

In other words, the invention consists in saturating the already thermally conditioned gas with the likewise thermally conditioned conditioning liquid, this being done in a reduced-pressure environment, thus promoting the evaporation process and optimizing the saturation phenomenon.

Advantageously, the saturation of the gas is self-regulated by the reduced pressure itself generated in the reduced-pressure environment. The device according to the invention enables these results to be obtained economically and efficiently.

This regulating device for conditioning a gaseous flow comprises, in a thermostatted enclosure intended to receive a heat transfer liquid, and immersed in this enclosure:

an inlet of gas at a programmed temperature, connected to a source of the said gas;

a gas humidifier for bringing a conditioning liquid into contact with the gas to be conditioned;

a conditioned gas outlet tubing connecting the outlet orifice of the humidifier to the volume to be conditioned.

According to the invention, the humidifier is formed by a pipe generating a partial vacuum by "Venturi" effect associated with a vaporization chamber supplied with conditioning liquid at a constant level, the Venturi pipe comprising, in order:

a converging region connected to the thermostatted inlet tubing;

a neck, a diverging region emerging in the vaporization chamber, the said vaporization chamber having:

a tubing connecting the conditioning liquid and emerging in the neck of the Venturi, and an outlet orifice disposed above the maximum level of the conditioning liquid in the said vaporization chamber.

In other words, the conditioning liquid brought to the neck of the Venturi pipe by the reduced pressure created thereat is atomised into the already thermally conditioned gaseous flow, this atomising in a reduced-pressure environment being furthermore effected at the temperature for conditioning the gas, the humidifier being immersed in the thermostatted enclosure. Thus, the evaporation process is promoted, considering that after its passage into the neck of the Venturi, where the flow rate of the gas and, consequently, the reduced pressure created thereat are the greatest, the gas indeed undergoes a reduction in temperature, but this reduction is immediately compensated by the convective heat transfer due to the flow of the gas along the conditioned walls of the diverging region. This evaporation is furthermore accentuated by the choice of a diverging region having a low apex angle, therefore of relatively long length, so that the flow rate of the gas is not immediate, maintaining in fact a certain reduced pressure. In other words, the walls of the diverging region compensate for the evaporation due to the adiabatic exchange. Furthermore, taking into account the particular structure of the device, the conditioning may result in heating as much as cooling of the volume, considering that the operational system is reversible.

Advantageously, the vaporization chamber comprises a liquid-gas separation chamber located above the level of the conditioning liquid and connected to the outlet tubing.

In a practical embodiment, the gaseous flow is compressed air and the humidifying liquid is water.

In a preferred embodiment, in order to obtain air conditioned to controlled and programmed hygrometry, the dry air inlet tubing is connected via a branch-off disposed outside the thermostatted enclosure to a controlled mixer valve connected to the outlet tubing of the vaporization chamber, the said mixer valve being connected in turn to the outlet tubing which traverses the thermostatted enclosure.

Advantageously, in practice:

the compressed gas is dry compressed air whose source is connected in series to the inlet tubing via a first pressure-reducing valve and then, by a drying means, via a second pressure-reducing valve associated with a valve in order to introduce into the inlet tubing compressed dry air at a constant flow rate;

in a known manner, the heat transfer liquid (advantageously water), of the thermostatted enclosure comprises an electrical resistance element, an agitator, a thermometer and a means for displaying and programming the temperature of the water and of the enclosure, the whole assembly being controllable from the outside;

the means for supplying the vaporization chamber with water to a constant level comprises, outside the thermostatted enclosure and in series, an expansion vessel, a first valve allowing a slight leakage of air, a reservoir of water thermostatted by the water of the enclosure, a controlled second valve and a tubing traversing the thermostatted enclosure connected to an orifice emerging in the vaporization chamber in order to maintain a constant level therein;

the outlet tubing has in series a controllable mixer valve connected to a pipe coil disposed in the thermostatted enclosure;

this mixer valve is associated with a slightly opened valve allowing a slight leakage intended to provide in all cases a minimum flow rate of air in the humidifier;

the constant level vaporization chamber comprises a succession of horizontal parallel grids or plates produced from a thermally conductive material, the said grids or plates then being integral with the vaporization chamber, and comprising a plurality of orifices which are offset from one plate or from one grid to another;

the leaktight humidifier immersed in the enclosure is produced from a heat conductive material and comprises fins for heat exchange with the thermostatted transfer liquid;

the tubing connecting the vaporization chamber and emerging in the neck of the Venturi has opposing orifices disposed horizontally in the cross-section of the neck;

the outlet orifice of the vaporization chamber is connected via a centrifuge-type droplet separator disposed in the enclosure above the said orifice, and whose outlet of saturated gas is connected to the tubing, the separated liquid subsequently returning by another tubing in the conditioning liquid via the orifice located below the constant level.

BRIEF DESCRIPTION OF THE DRAWINGS

The manner in which the invention may be carried out and the advantages which stem therefrom will better emerge from the embodiment which follows in support of the attached figures.

DESCRIPTION OF THE INVENTION

Figure 1:
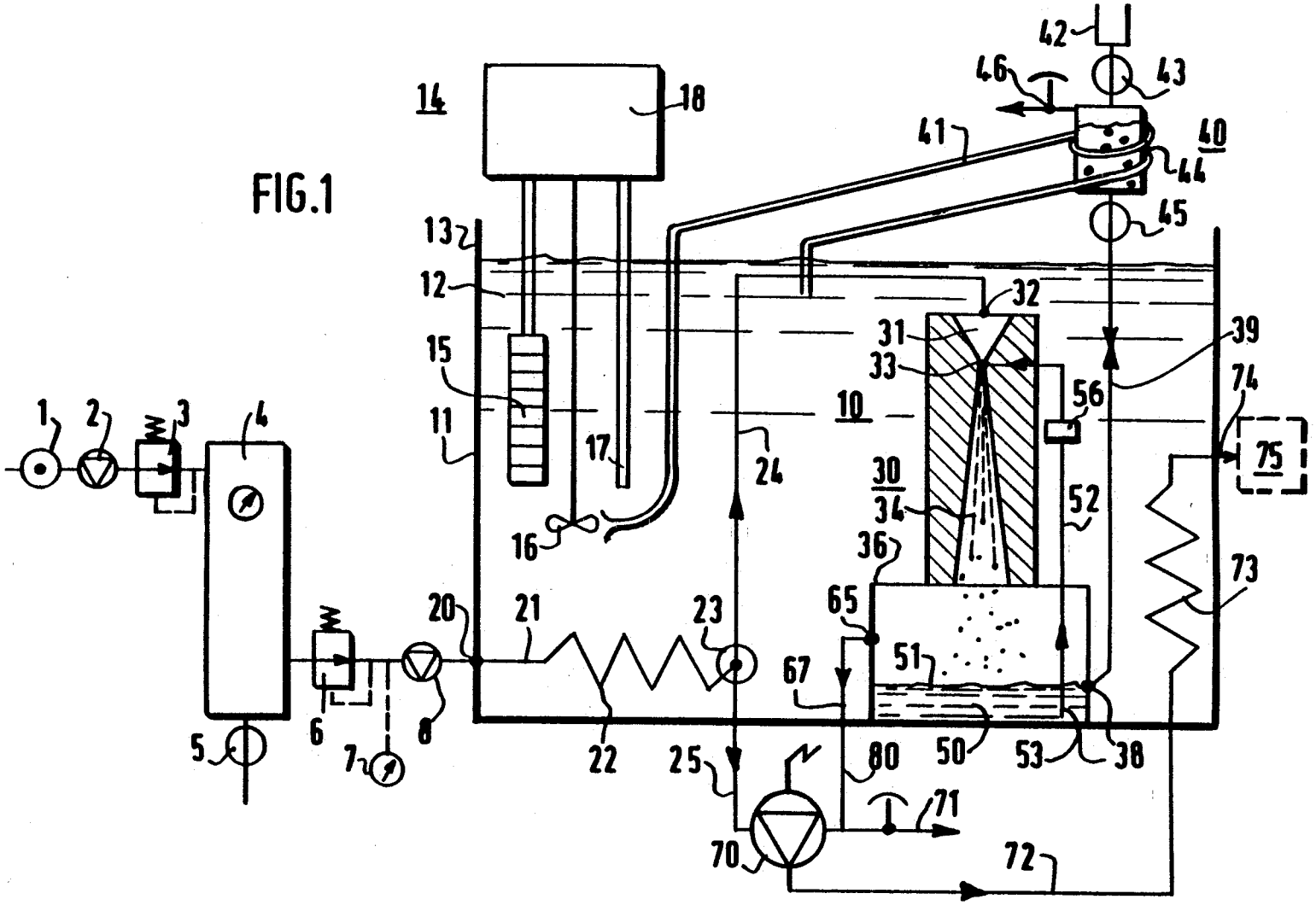
FIG. 1 is a diagrammatic representation of a preferred device of the invention.

The device in accordance with the invention for producing air conditioned to controlled and programmed hygrometry first of all comprises a source of air, for example compressed air (1) such as a compressor, a cylinder etc., connected via a tubing to a valve (2) and then to a pressure-reducing valve (3) regulating the pressure. This pressure-reducing valve (3) is connected in turn to a known hygroscopic desiccator assembly (4), for example of the type denoted by "VAN AIR" marketed by AUXITROL which, in a known manner, has a purge (5). This desiccator assembly (4) is connected in turn to a second pressure-reducing valve (6) and then to a manometer (7) and to a valve (8) so as to provide a constant flow rate of dry air into the inlet tubing (21) (pressure of the dry compressed air in the valve (8) between six hundred and a thousand kPa).

The actual conditioning device designated by the general reference (10) comprises a thermostatted enclosure (11), advantageously thermally-insulated, filled with distilled water (12) to a level (13). This enclosure (11) is thermostatted by a known means (14) essentially comprising, immersed in the water, an electrical resistance element (15), an agitator (16) associated with a circulation pump, a thermometer (17) and an apparatus (18) for displaying and program control of the temperature, the assembly being controllable from the outside.

The dry compressed air emerges in the enclosure (11) via an orifice (20) and is then connected to an inlet tubing (21) forming a pipe coil (22) immersed in this enclosure. This tubing (21) and the pipe coil (22) are connected via a T connector (23) to two other tubings, respectively an immersed tubing (24) and another tubing (25) which is not immersed totally and leaves the enclosure (11). The immersed tubing (24) is connected to the humidifier (30) characteristic of the invention.

Figure 2:
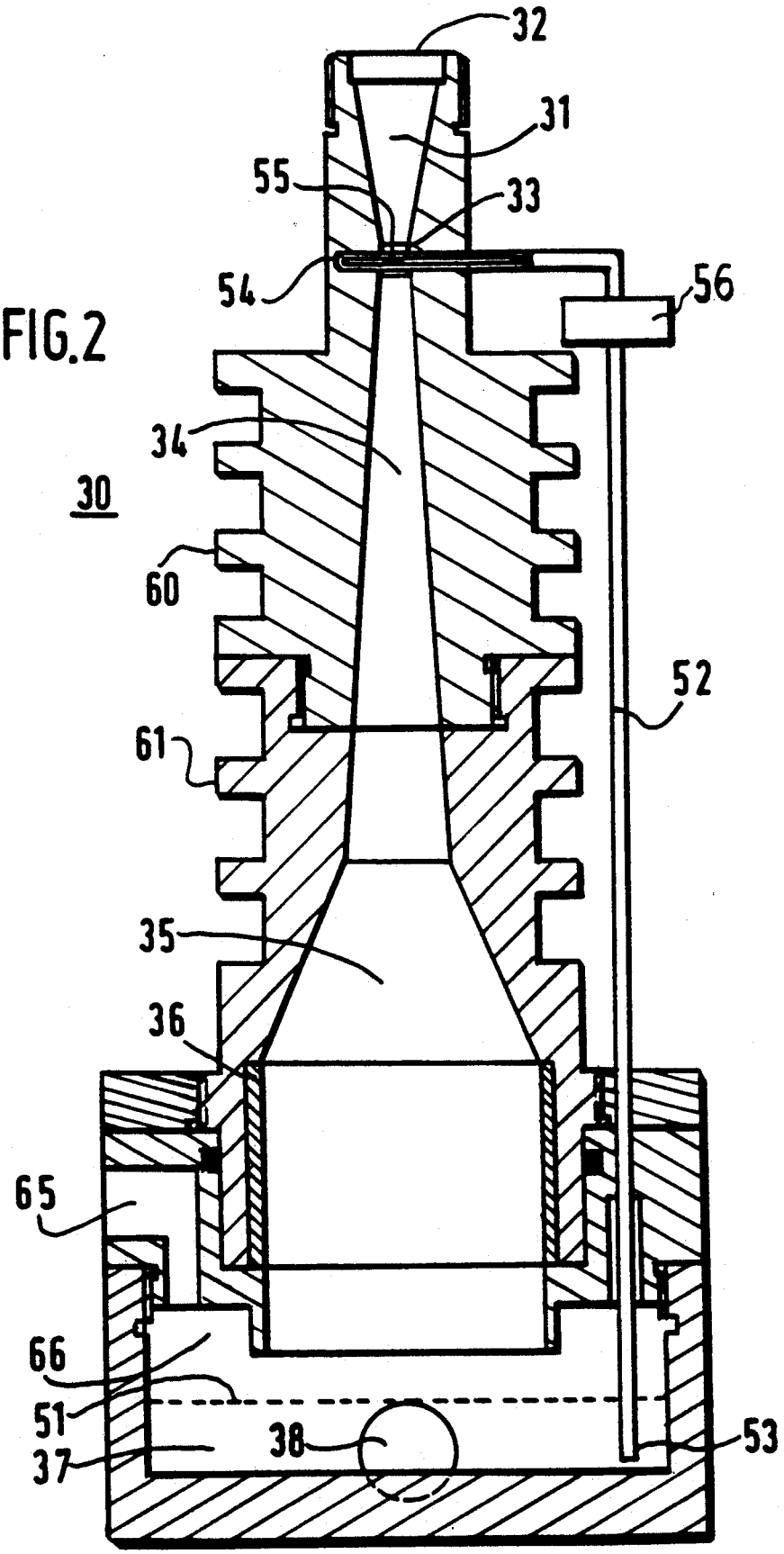
FIG. 2 is a cross-sectional representation of the leaktight assembly characteristic of the invention.

This leaktight characteristic humidifier (30) detailed in FIG. 2 essentially comprises a pipe generating a partial vacuum or reduced pressure by Venturi effect associated with a vaporization chamber (36). The Venturi tube is formed, in order, by a converging region (31) connected upstream (32) to the immersed dry air inlet tubing (24) and then, downstream, to a neck (33). This neck (33) is associated with a diverging region (34) connected in turn via a conical connector (35) to the characteristic cylindrical vaporization chamber (36). In a practical embodiment, for a Venturi pipe of axial symmetry, the apex angle of the converging region (31) is approximately 21°, while the apex angle of the diverging region (34) is approximately 6° or 7°.

The characteristic vaporization chamber (36) has at the bottom (37) an orifice (38) connected via a tubing (39) immersed in the enclosure (11) to a water supply means designated by the general reference (40) and disposed outside this enclosure (11). This water supply means (40) is thermostatted by a pipe coil tubing (41) drawing water (12) from the thermostatted enclosure (11). This water supply means (40) disposed outside the enclosure essentially comprises, in order, an expansion and distilled-water supply vessel (42) connected to a manual valve (43) and then to an actual reservoir (44), emerging onto an electropneumatically controlled valve (45) connected to the immersed tubing (39). The valve (43) is slightly opened in such a manner as to provide a certain air leakage flow rate and therefore to maintain the water (50) in the vaporization chamber (36) at a constant level (51), defined by the orifice (38).

According to another characteristic of the invention, the distilled water (50) of the vaporization chamber (36) is connected via a tubing (52) first of all to a dust filter (56) intended especially to avoid clogging up and then to the spray nozzle disposed in the neck (33) of the Venturi. The lower end (53) of this tubing (52) is disposed below the level (51) so that the neck (33) is permanently supplied with distilled water. The upper end (54) of the tubing (52) emerges exactly in this neck (33) which, for this purpose, has two opposing traversing orifices (55) disposed horizontally facing each other in the actual cross-section of the neck (33), thus forming the spray nozzle.

In a known manner the Venturi induces in the diverging region (34) a reduced pressure which leads to suction of the water (50) at the neck (33) and its instantaneous atomising in the form of fine droplets into the diverging region (34), some of which droplets fall back into the chamber (36).

Advantageously the characteristic humidifier (30) is machined from bronze and is therefore thermally conductive. Furthermore, it comprises fins (60, 61) intended to facilitate the heat exchange with the thermostatted transfer liquid (12). Thus, the temperature of the diverging region (34) and of the vaporization chamber (36) is very close to the temperature of the thermostatted liquid.

In a practical embodiment, the vaporization chamber (36) has two horizontal plates (not shown), pierced by traversing orifices offset from one plate to another, or two appropriate grids, this being done in order to cause the deposition on these plates or on these grids of water drops conveyed by the saturated air. Furthermore, it is possible advantageously to insert, between the two grids, sintered metal, in the form of shot, or even "PORAL" (registered trade mark). These plates or grids are advantageously made from a thermally conductive material, thus enabling the condensation or the evaporation of the liquid, depending on the case, to be achieved by increasing the heat exchange surface. Furthermore, these grids act as a regulator, insofar as when the water droplets are deposited on the said grids, thus diminishing the air flux traversing the grids, they reduce in fact the pressure difference between the neck (33) of the Venturi and the vaporization chamber. Thus, the quantity of distilled water sucked into the neck (33) is reduced, and consequently the atomising is diminished. In fact, a smaller quantity of droplets is deposited onto the grids, increasing the pressure difference again and hence the quantity of atomised water in the neck (33). Thus a self-regulation of the saturation and a steady state in relation to the assigned reference value are obtained.

According to another characteristic of the invention, the vaporization chamber (36) has, above the constant level (51) of the water, an outlet orifice (65) by which air virtually saturated with vapour will escape. This outlet orifice (65) for saturated air is disposed just above an annular chamber (66), is then connected via an immersed tubing (67) to a controlled mixer valve (70) disposed, for example, outside the enclosure (11) and is also connected to the non-immersed dry air inlet tubing (25). If it is desired to work at high temperature, it is then preferable that the mixer valve (70) be also immersed in the enclosure (11).

Figure 4:
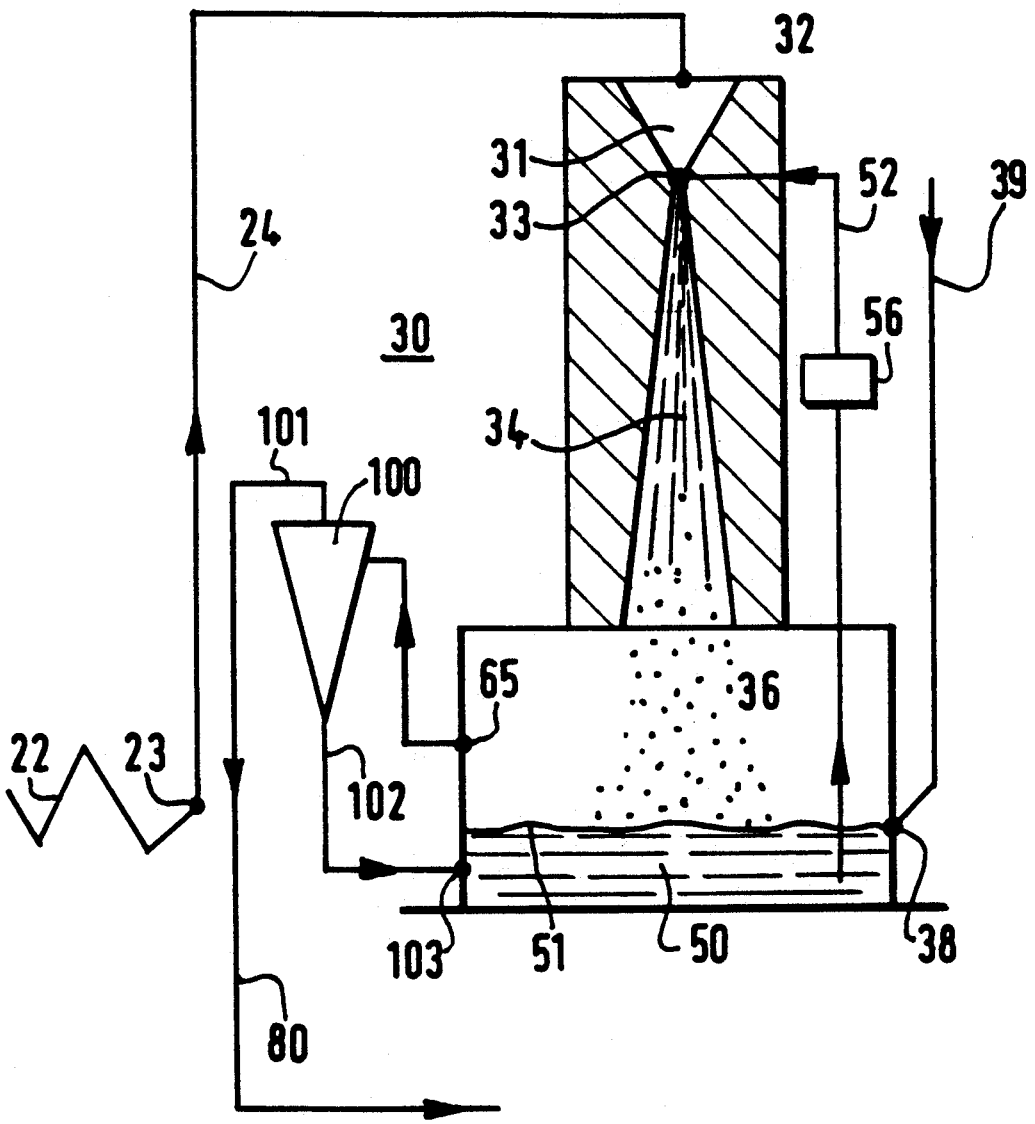
FIG. 4 shows an embodiment detail suitable for constructions requiring large flow rates.

For large flow rates into the humidifier (30) (see FIG. 4), there is placed between the orifice (65) and the tubing (67) a centrifuge-type droplet separator (100) disposed in the enclosure (11) above the orifice (65) and whose outlet (101) for saturated gas is connected to the tubing (80). The separated liquid subsequently returns via the tubing (102) into the liquid (50) via the orifice (103) located below the constant level (51).

The mixer valve (70) is advantageously associated with another valve (71) intended to maintain a slight leakage in order for the water in the tubing (52) to rise. The mixer valve (70) is then connected via a tubing (72) to an immersed pipe coil (73) which is connected via a new tubing (74) disposed outside the enclosure (11) to the volume (75) to be conditioned.

The gas conditioning device according to the invention operates in the following manner.

Compressed air (1) is brought to temperature by traversing the thermostatted enclosure (11). Its forced passage into the Venturi (31, 33, 34) causes suction of the water (50) contained in the vaporization chamber (36) by means of the pipe (52) and of its filter (56). The water which then emerges in the neck (33) of this Venturi saturates the air which traverses it. This air, after the heaviest water drops have been discharged onto the horizontal plates of the vaporization chamber (36), leaves the latter via the orifice (65) and the pipe (67) until reaching the mixer valve (70). This valve (70) is controlled so that the air which escapes therefrom (72) has a specified hygrometry. In fact, for one precise position of this valve (70) there corresponds one stable air humidity. If it is desired to control the operation more precisely, it is possible to measure the temperature and the humidity in the volume (75) to be conditioned and the reference value is maintained at 0.1% relative humidity by small pulses to this valve (70).

In an embodiment not shown, the automated conditioning device according to the invention furthermore comprises:

- an apparatus for measuring the temperature and the vapour concentration of conditioned gas (75);
- a microprocessor system equipped with a digital-/analog, input/output multifunctional card and specific software for monitoring and controlling the controllable elements, such as (2, 6, 8, 14, 45, 70), managing the programmed temperature and vapour concentration reference values.

The water atomised in the neck (33) is partly evaporated in the diverging region (34) and the chamber (36) and the excess falls back into the reservoir (37). The heat transfer necessary for this evaporation is produced by the conductive body of the humidifier (30) provided with exchange fins (60, 61). As already mentioned, the separation of the droplets and an additional evaporation is obtained by passage through baffles (plates, grids) located in the chamber (36). Taking into account the actual structure of the humidifier, a maximum heat transfer is observed at the start of the diverging region and therefore as soon as the droplets in the latter depart, and this is because of the greatly reduced pressure which prevails in this place. This transfer diminishes with the widening out of the diverging region (34) and hence, corollarily, with the rise in pressure. This heat exchange is moreover optimized by adopting a diverging region having a tapered profile (6° apex angle). Thus a uniform heating of the assembly is obtained and a constant heat transfer for a given flow rate.

The saturated air (67) produced is then mixed with dry air (25) in a controllable mixer valve (70) in order to produce the conditioned air (75). If a slight air leakage (at 43) allows a scavenging and the maintenance of the constant water level (51) in the chamber (36), another controlled leakage (71) also allows the maintenance of a slight flow rate necessary for the atomisation when relatively dry air is desired. In fact, this controlled leakage (71) makes it possible to eject saturated air and, correlatively, prevents the deactivation of the Venturi. Finally, it makes it possible to use this device even for very small flow rates, insofar as the head loss is permanently maintained.

The air contained in the chamber (36) exerts a greater pressure on the column of water contained respectively in the tubing (39) and in the reservoir (44). As the valve (43) allows a slight air leakage flow rate, there is established a reverse water-air flow in the pipe (39) such that if the water level (51) in the vaporization chamber (36) extends beyond that of the top point of the orifice (38), the excess water is driven back into the reservoir (44). On the other hand, when the water level (51) in the chamber (36) is below the top point of the orifice (38), the water falls from the reservoir (44) towards the chamber (36). Thus, the water level in the vaporization chamber (36) is regulated, by excess or by deficiency, the precision of regulation being fixed by the air leakage flow rate allowed by the valve (46). The reservoir (44) may be filled in a complementary manner from the expansion vessel (42) after closing the controlled valve (45) and opening the valves (43) and (46).

Figure 3:
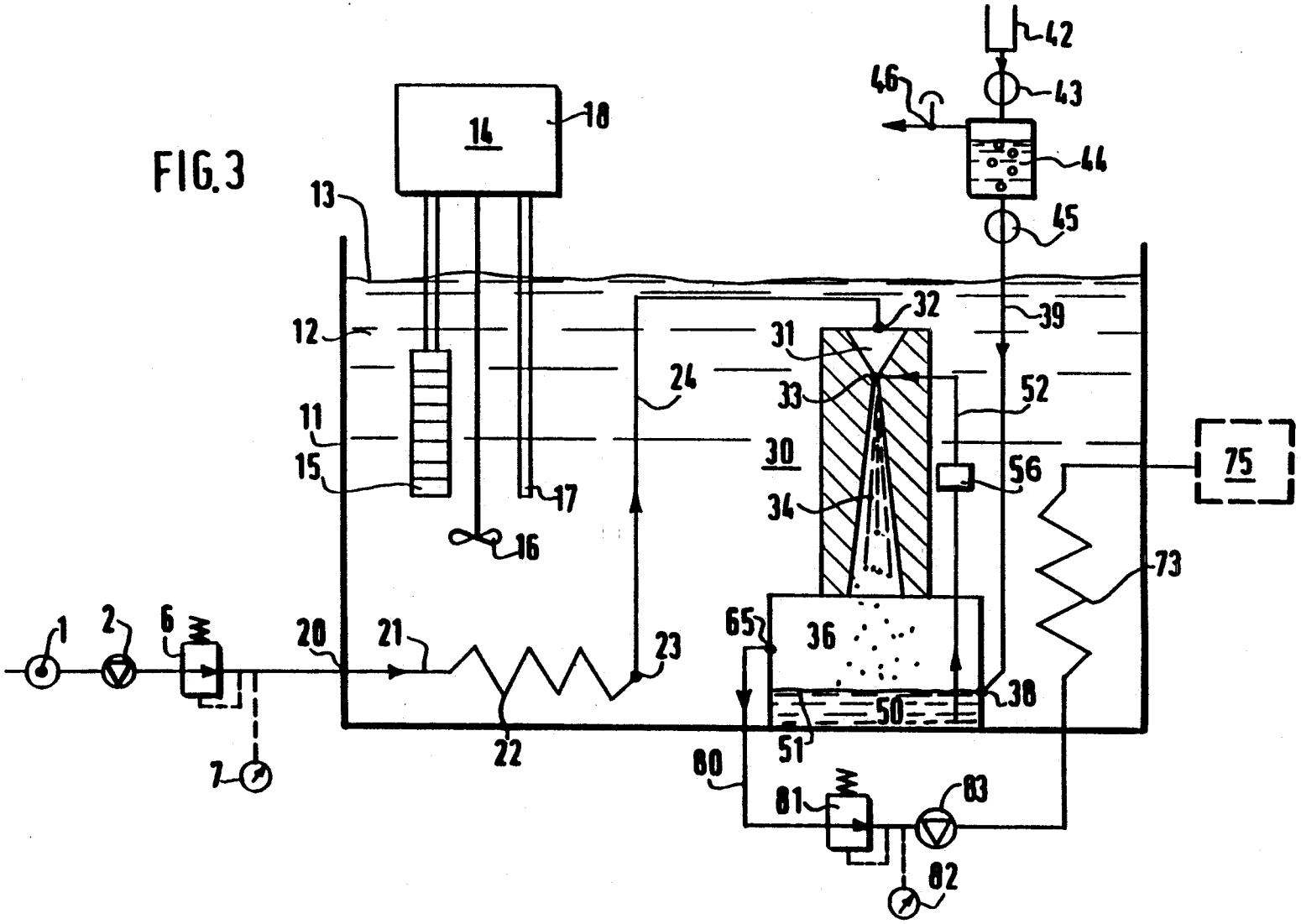
FIG. 3 is a diagrammatic representation of a simplified embodiment of the invention.

FIG. 3 shows, as already mentioned, a simplified embodiment of the invention. The parts common to FIGS. 1, 2 and 3 have kept the same references.

In this embodiment, the pressure of the compressed air (1) is reduced to a reference pressure by its passage into a controlled pressure-regulating pressure-reducing valve (6) before the inlet (20) of the thermostatted enclosure (11). The dry air inlet tubing (24) is integrally connected to the leaktight humidifier (30) and the outlet orifice for saturated air (65) is integrally connected to an associated tubing (80, 67) in series with a pressure-reducing valve (81), then to a manometer (82) and a valve (83), and, still in series, to the immersed pipe coil (73) connected in turn to the volume (75) to be conditioned. As a variant, the pressure-reducing valve (81)/valve (83) assembly may be replaced by a flow regulator. Thus, by simply making the flow rate vary, it is possible to obtain the desired conditioning of the volume (75) with gas of constant water vapour concentration, directly depending on the pressure and the temperature prevailing in the humidifier (30).

In this embodiment, the operation of the equipment is particularly stabilized in terms of constant air flow rate. The humidity variations of the output air (75) are directly related to the pressure and to the temperature in the humidifier (30), and to the temperature and pressure of use. This completely reversible form of use may also serve to dehumidify the air for the conditioning of rooms for example, or may be used for compressed gases other than air and liquids other than water. This solution is particularly advantageous as it leads to controlled air which is calculable from known physical laws as everything passes via the Venturi (33). Thus regardless of the humidity required, the flow rate is always constant in the vaporization chamber (36).

The device according to the invention has numerous advantages in relation to those known and marketed to date. Mention may be made of:

- a high degree of compactness and a small size;
- the possibility of obtaining large flow rates conditioned efficiently, which the solutions described in the preamble did not permit;
- autonomous operation;
- operational flexibility;
- programming and management of the conditioning by means of a microcomputer or programmable automaton;
- increased efficiency through the use of a particularly high-performance humidifier.

Thus, this device may be used successfully for conditioning any volume or any enclosure requiring a relative humidity precisely controlled and programmed, such as, for example, in measurement apparatuses, especially of laboratories, or in spray guns, for example for paint, gas and solvent mixtures etc.

We claim:

1. A device for conditioning a gaseous flow, comprising a thermostatted enclosure (11) for receiving a heat transfer liquid (12) that is immersed in the enclosure, an inlet means (21, 22) of gas at a programmed temperature which is connected to a source (1) of gas, a gas humidifier (30) for brining a conditioning liquid (50) into contact with the gas, a conditioned gas outlet tubing (67, 72, 73, 74, 80) connected to an outlet orifice of the humidifier to a volume (75) to be conditioned, the device including a humidifier means (30) having a Venturi pipe for producing a partial vacuum by a Venturi effect that is connected to a vaporizing chamber (36) containing a conditioning liquid at a constant level (51), said Venturi pipe further including a converging region (31) connected to thermostatted inlet tubing (24), a neck (33) and a diverging region (34) emptying into the vaporizing chamber further including supply tubing (52) connecting the conditioning liquid (50) in the vaporizing chamber to the neck (33) of the Venturi means and an outlet orifice (65) disposed above the liquid level in the vaporizing chamber (36), said vaporization chamber (36) has a means (40) for supplying liquid to a constant level (51), formed by an expansion vessel (42), a first valve (43) allowing a slight leakage, a thermostatted liquid reservoir (44) and a controlled second valve (45), said means (40) disposed outside or inside the enclosure (11) being connected via a tubing (39) which traverses the enclosure (11) and is connected to an orifice (38) emerging in the vaporization chamber (36) having a constant level (51).

2. Conditioning device according to claim 1, characterized in that the end of the supply tubing (52) connecting, by means of a filter (56), the vaporization chamber

(36) to the neck (33) of the Venturi, comprises two traversing orifices (55) facing each other horizontally in the cross-section of the neck (33).

3. Conditioning device according to claim 2, characterized in that the vaporization chamber (36) having a constant level (51) comprises a succession of horizontal plates or grids made from a thermally conductive material, and integral with the said chamber, the grids or plates comprising a plurality of orifices offset from one plate in relation to another, which are intended to stop the condensation droplets of the conditioning liquid and, hence, to promote the heat exchange between the saturated gas and the vaporization chamber.

4. Conditioning device according to claim 3, characterized in that the outlet orifice (65) of the vaporization chamber (36) is connected via a centrifuge-type droplet separator (100) disposed in the enclosure (11) above the said orifice (65) and whose saturated gas outlet (101) is connected to the tubing (80), and in that the separated liquid returns via the tubing (102) into the liquid (50) via the orifice (103) situated below the constant level (51).

5. Conditioning device according to any claim 4, characterized in that the dry gas inlet tubing (22) is connected via a branch-off (23) to a second tubing (25) connected via a controlled mixer valve (70) to the saturated gas outlet tubing (67) of the vaporization chamber (36), the said mixer valve (70) being connected in series, in turn, to a thermostatted tubing (73) connected to the outlet tubing (74).

6. Conditioning device according of claim 4, characterized in that the gas (1) is compressed and is previously pressure-regulated at the input by a controllable means (6) and is integrally introduced into the converging region (32) of the Venturi, and in that the saturated gas (80) coming from the vaporization chamber (36) has a pressure which is reduced at a constant rate (80, 81, 83) to the pressure of use, so as to obtain a conditioning of the gas to a constant concentration of vapour of the cooling liquid and directly depending on the temperature and pressure in the humidifier (30).

7. Conditioning device according to claim 6, characterized in that the gas (1) to be conditioned is compressed air and in that the conditioning liquid (50) is water.

8. Conditioning device according to claim 7, characterized in that the source of compressed air (1) is connected to the inlet tubing (21) in series via a pressure-reducing valve (3), a drying means (4) and a second pressure-reducing valve (6) in order to bring into the tubing (21) dry air at a constant rate.

9. Apparatus for conditioning a gas that is supplied to a room for achieving a desired gas temperature and humidity therein that includes a housing containing a heating liquid and heating means for bringing the heating liquid to a desired temperature, a gas humidifying means contained in said housing that is immersed in said heating liquid, said humidifying means further including a Venturi means having an entrance, a mixing throat and a discharge that empties into an enclosed vaporizing chamber, a supply of dry gas located outside said housing connected to a first supply line for bringing said dry gas through the heating liquid to the entrance of said humidifying means whereby the dry gas is heated to said desired temperature, a supply of conditioning liquid located outside said housing connected to a second supply line for bringing said conditioning liquid into said vaporizing chamber whereby the conditioning liquid is heated to said desired temperature, a third supply line for bringing conditioned liquid from said vaporizing chamber to the throat of said humidifying means whereby said heated dry gas is saturated with said heated conditioning liquid, and discharge means for delivering saturated gas from said vaporizing chamber to a room to condition said room.

10. The apparatus of claim 9 wherein said heating liquid is water and said gas is air.

11. The apparatus of claim 9 that further includes a filter means located in said third supply line.

12. A method for conditioning a room enclosure that includes the steps of mounting a Venturi means within a house, discharging the Venturi means into a vaporizing chamber located within said housing, mounting a supply of dry gas outside said housing and passing said gas through the housing to the entrance of the Venturi means, mounting a supply of conditioning liquid outside the housing and bringing said conditioning liquid through said housing to the throat of said Venturi means so that saturated gas is discharged from said Venturi means into said vaporizing chamber, filling the housing with a heating fluid, and heating the heating fluid to a desired temperature so that the dry gas and the conditioning liquid are maintained at the desired temperature as they pass through said Venturi means.

13. The method of claim 12 that includes the further step of discharging the saturated gas from the vaporizing chamber into a room enclosure.

14. The method of claim 13 that includes the further step of passing the saturated gas discharged from the vaporizing chamber back through the heating fluid prior to delivery thereof to the room enclosure.

15. The method of claim 12 that includes the further step of maintaining the liquid in the vaporizing chamber at a desired level.

16. The method of claim 12 wherein conditioning liquid is first brought into the vaporizing chamber and then into the throat of said Venturi means.

* * * * *